US007706704B2

(12) United States Patent
Lang et al.

(10) Patent No.: US 7,706,704 B2
(45) Date of Patent: Apr. 27, 2010

(54) DIGITAL PRINTING APPARATUS HAVING SUBSTANTIALLY EQUAL OUTPUT RATES FOR VARIOUS SHEET SIZES AND ORIENTATIONS

(75) Inventors: Joseph H Lang, Webster, NY (US); Patrick T Pendell, Rochester, NY (US); Neil J Dempsey, Victor, NY (US)

(73) Assignee: Xerox Corporation, Norwalk, CT (US)

( * ) Notice: Subject to any disclaimer, the term of this patent is extended or adjusted under 35 U.S.C. 154(b) by 692 days.

(21) Appl. No.: 11/423,607

(22) Filed: Jun. 12, 2006

(65) Prior Publication Data

US 2007/0286619 A1 Dec. 13, 2007

(51) Int. Cl.
*G03G 15/00* (2006.01)

(52) U.S. Cl. ..... 399/45

(58) Field of Classification Search ..... 399/45
See application file for complete search history.

(56) References Cited

U.S. PATENT DOCUMENTS

| | | | | |
|---|---|---|---|---|
| 4,588,284 | A | | 5/1986 | Federico et al. |
| 4,712,906 | A | * | 12/1987 | Bothner et al. ..... 399/303 |
| 5,455,656 | A | | 10/1995 | Covert et al. |
| 5,933,679 | A | | 8/1999 | Palumbo |
| 6,844,937 | B2 | | 1/2005 | Dempsey et al. |

* cited by examiner

*Primary Examiner*—David M Gray
*Assistant Examiner*—Ruth N Labombard
(74) *Attorney, Agent, or Firm*—Ronald E. Prass, Jr.; Press LLP

(57) ABSTRACT

A digital printing apparatus is controlled to provide a roughly consistent output rate, of printed sheets per minute, regardless of the size and orientation of the output print sheets. In one embodiment, the printer outputs short-edge-fed legal or A3 sheets within 25% of the rate it can output long-edge-fed letter or A4 sheets.

12 Claims, 2 Drawing Sheets

DIGITAL PRINTING APPARATUS HAVING SUBSTANTIALLY EQUAL OUTPUT RATES FOR VARIOUS SHEET SIZES AND ORIENTATIONS

TECHNICAL FIELD

The present disclosure relates to digital printing apparatus, such as xerographic printers and copiers.

BACKGROUND

Certain types of customers have unusual demands on office equipment. It is conceivable that a customer would like a printer (the term "printer" including a printer, copier, or multifunction device, such as including facsimile scanning and printing) to have a roughly similar output rate, in terms of number of printed sheets per minute, regardless of the size and/or process orientation of the sheets coming out of the printer (long-edge feed or short-edge feed). In one practical situation, a customer may desire that the output rate for letter-size long-edge feed sheets and legal-size short-edge feed sheets be roughly equal.

It is known that a basic hardware "platform" of a given type of printing apparatus, such as a xerographic printer, can be readily controlled, such as via software, to have a particular output speed: predetermined voltages can be applied to motors, data can be sent to a laser at a predetermined rate, etc. More specifically, larger xerographic printers can be controlled to have a certain number of "pitches", or page-size image areas, associated with each rotation of a rotatable photoreceptor drum or belt. By controlling the machine to have more or fewer images of a given size placed on the photoreceptor with each rotation, the speed of the apparatus, in terms of output prints per minute, can be altered.

U.S. Pat. Nos. 4,588,284; 5,455,656; and 5,933,679 describe control systems in which a xerographic copier with a multi-pitch photoreceptor belt is controllable to operate with a selectable number of active pitches per belt rotation. U.S. Pat. No. 6,844,937 describes a system in which a digital printer can operate at one of a set of selectable output rates, with a different per-print "click charge" to a user depending on the selected print output rate.

SUMMARY

According to one aspect, there is provided a method of operating a printing apparatus, the apparatus having a control system and an imaging member movable in a process direction. In response to a user indicating a print sheet output size, the control system operates the printing apparatus in one of a first output rate and second output rate, the first output rate resulting from a first pitch spacing and a first velocity of the imaging member, and the second output rate resulting from a second pitch spacing and a second velocity of the imaging member. The second sheet output rate is within 25% of the first sheet output rate, and the second pitch spacing is consistent with a print sheet having a length along the process direction greater than 20% of a length of a print sheet output at the first sheet output rate.

DETAILED DESCRIPTION

Figure 1:
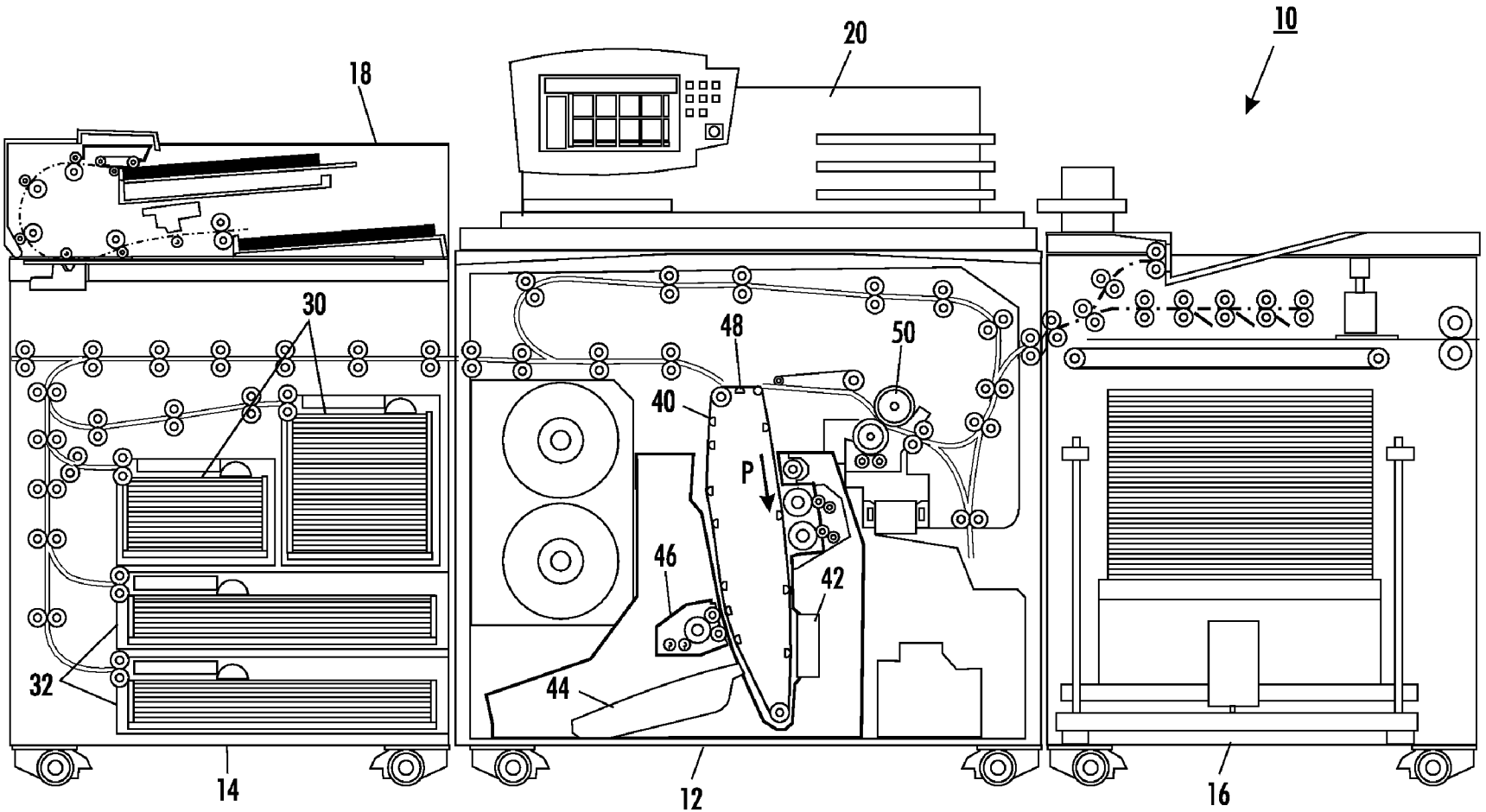
FIG. 1 PRIOR ART
FIG. 1 is an elevational view showing the basic elements of a high-speed digital copier-printer.

FIG. 1 is an elevational view showing the basic elements of a high-speed digital copier-printer. Although a xerographic, monochrome "laser printer" is shown, it will be understood that the present description can be applied to any type of digital printing apparatus, such as xerographic, ionographic, or ink-jet, as well as color or monochrome.

In this embodiment, a printer 10 includes a marking engine 12, which includes hardware by which image signals are used to create a desired image, as well as a feeder module 14, which stores and dispenses sheets on which images are to be printed, and a finisher 16, which may include hardware for stacking, folding, stapling, binding, etc., prints which are output from the marking engine. If the printer is also operable as a copier, the printer further includes a document feeder 18, which operates to convert signals from light reflected from original hard-copy image into digital signals, which are in turn processed to create copies with the marking engine 12. The printer 10 may also include a local user interface 20 for controlling its operations, although another source of image data and instructions may include any number of computers to which the printer is connected via a network.

With reference to feeder module 14, the module includes any number of trays 30, 32, each of which stores print sheets ("stock") of a predetermined type (size, weight, color, coating, transparency, etc.) and includes a feeder to dispense one of the sheets therein as instructed. Sheets drawn from a selected tray are then moved to the marking engine 12 to receive one or more images thereon. In the illustration, trays 30 feed letter or A4-sized stock in a "long-edge feed" manner (the long edge of each sheet leads and trail the sheet moving through the machine) and trays 32 feed legal or A3-sized stock in a "short-edge feed" manner (the short edge of each sheet leads and trail the sheet moving through the machine).

In this embodiment, marking engine 12 includes a photoreceptor 40, here in the form of a rotatable belt. The photoreceptor 40 is entrained on a number of rollers, and a number of stations familiar in the art of xerography are placed suitably around the photoreceptor 40, such as charging station 42, imaging station 44, development station 46, and transfer station 48. In this embodiment, imaging station 44 is in the form of a laser-based raster output scanner, of a design familiar in the art of "laser printing", in which a narrow laser beam scans successive scan lines oriented perpendicular to the process direction of the rotating photoreceptor 40. The laser is turned on and off to selectably discharge small areas on the moving photoreceptor 40 according to image data to yield an electrostatic latent image, which is developed with toner at development station 46 and transferred to a sheet at transfer station 48.

A sheet having received an image in this way is subsequently moved through a fuser 50, of a general design known in the art, and the heat and pressure from the fuser causes the toner image to become substantially permanent on the sheet. For duplex or two-sided printing, the printed sheet can then be inverted and re-fed past the transfer station 48 to receive a second-side image. The finally-printed sheet is then moved to finisher module 16, where it may be collated, stapled, folded, etc., with other sheets in manners familiar in the art.

It can be seen that there are many possible ways to control the output speed, in terms of prints of a certain size and type per minute, of the whole printing apparatus 10. In a basic sense, the various motors which feed sheets from a stack 30 or 32 through the machine can be readily controlled, whether they are AC, DC, or servo motors, to operate at a certain speed; depending on the desired output speed, which of course directly affects the rotational speed of the photoreceptor 40, the rate of data flow operating the laser (or equivalent device) in imaging station 44 is adjusted as well.

Another technique for controlling the output speed of the printing apparatus 10 relates to what is called "pitch configuration", "pitch spacing", or "pitch skipping". An image receptor such as photoreceptor 40 has an effective imaging area which can accommodate a certain maximum number of pitches, or spaces for placing images of a certain size thereon. In a typical example in a high-speed, high-volume design such as shown in FIG. 1, the photoreceptor 40 can theoretically accommodate six page-size (letter or A4, long-edge feed) pitches along its circumference. As a practical matter, though, it can be desirable to space the pitches out around the photoreceptor 40, so that there would be only five actual letter-size pitches, along with a zone between each pitch along the circumference. It is also certainly possible to provide for four or three letter-size pitches per rotation, with even greater spacing between pitches. Each fewer imaged pitch per rotation of photoreceptor 40 proportionally decreases the output speed of the printer: four pitches per rotation, all else being equal, yields an output speed ⅔ that of six pitches per rotation. The number of pitches per rotation of the photoreceptor 40 is ultimately determined by the operation of the imaging station 44 coordinated with the speed of the photoreceptor 40 and the feeding of sheets past transfer station 48.

As a practical matter, it should be noted that to operate a xerographic or other printer 10 at a wide range of speeds, other adjustments have to be made. For example, no matter how the change in speed is effected (by pitch spacing, motor control, or both), certain "setpoints" must be optimized for the selected speed. In the present embodiment, changes in speed must typically be accompanied by adjustments to the voltage applied to a motor driving the photoreceptor 40, the initial charging at charging station 42, the power associated with the imaging station 44, the biases and other aspects associated with development station 46 and transfer station 48, and the temperature control associated with fuser 50. A control system associated with the printer must retain what can be called "setpoint data" which instructs the various stations how to operate at a particular speed. Setpoint data can be in the form of a fixed value, e.g., at 100 pages per minute (ppm) the charging device must be biased to a certain fixed number of volts; or the setpoint data can be in the form of a constant to be placed in a control algorithm, or a whole algorithm which is used in controlling a particular station.

In one embodiment, a single printer such as shown in FIG. 1 is adapted to operate in one of at least two modes, each mode for outputting a particular size of sheet, such as letter and legal or A4 and A3; in one embodiment, the length along process direction P of sheets output in the second mode is greater than 20% of sheets output in the first mode. In a first mode, the printer runs at a selected pitch spacing and photoreceptor velocity (as well as other setpoint values as required) consistent with a first output rate (that is, number of pages output per minute). In a second mode, the printer runs at a selected pitch spacing and photoreceptor velocity consistent with a second output rate. The second output rate is roughly similar (such as 25% or closer) to the first output rate, so that, to a casual user, the output rate of the printer as a whole is the same regardless of what size print sheet is being output at a given time.

Figure 2:
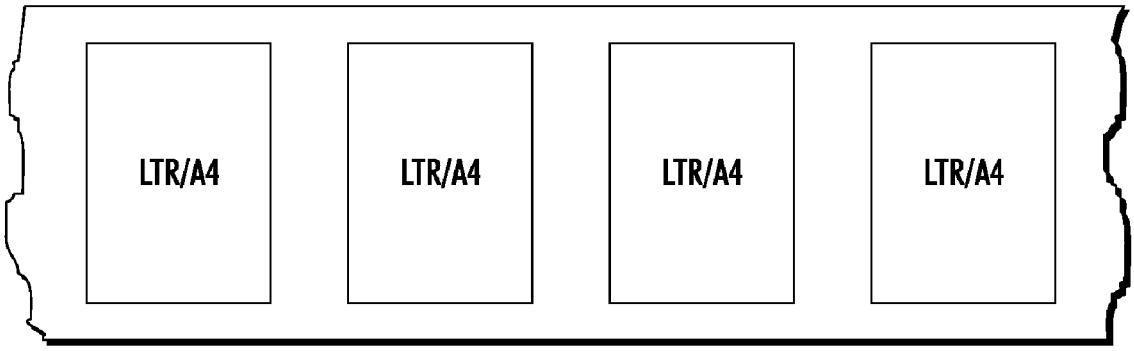
FIGS. 2 and 3 are comparative plan views of an imaging belt, demonstrating the placement of sheet-sized images thereon.
Figure 3:
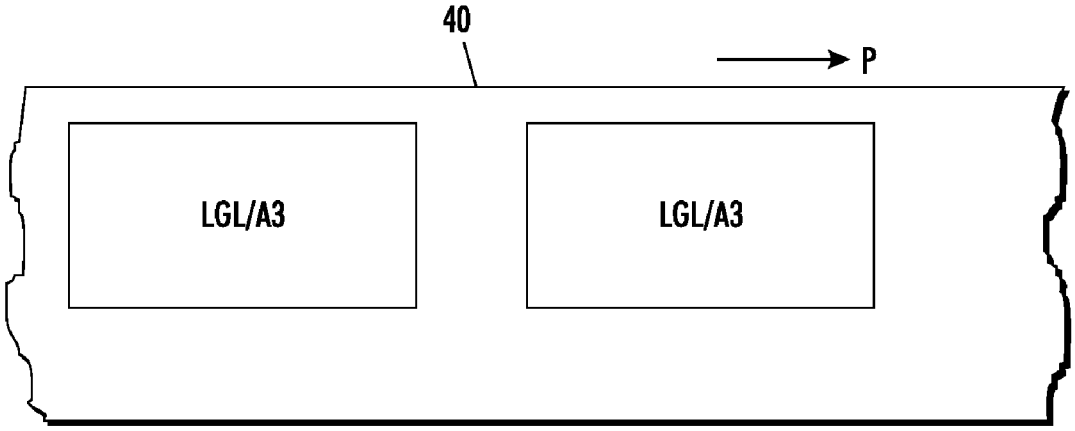

FIGS. 2 and 3 are comparative plan views of an imaging belt 40 as shown in FIG. 1, demonstrating the placement of sheet-sized images thereon. In one practical embodiment, using the basic hardware architecture as shown in FIG. 1, the width of the photoreceptor belt 40 is adequate for a long-edge feed of a letter or A4 sized sheet, as shown in FIG. 2, but not for a long-edge feed of a legal or A3 sheet: legal and A3 sheets must be imaged on the belt 40 as short-edge feed, meaning the long edges thereof take up a length of along the process direction P (direction of motion of the belt), as shown in FIG. 3. The length of unused "interdocument zones", between areas receiving images for printing on the belt 40, an aspect of pitch spacing, will also affect the output rate for a given mode. Because each sheet-sized image in A3/legal mode takes up more length of the belt 40, in order for the A4/letter output rate and the A3/legal output rates to be roughly equal, the velocity of the belt 40 in the A3/legal mode must be greater.

In the comparison between the letter/A4 long-edge feed of FIG. 2 and the Legal/A3 short-edge feed of FIG. 3, it can be seen that the difference in length along the belt 40 for the legal/A3 sheet is equal to or greater than 50%, not including interdocument zones: the 14 inch length of a legal sheet is 64% longer than the 8½ inch length of a letter sheet along the process direction. In the embodiment, the velocity of the belt 40 (along with other parameters, such as data output operating an imaging laser) is increased to compensate for the longer length of the belt apportioned for each output sheet.

A practical advantage of the disclosed method is that it enables comparable performance for significantly different sheet sizes, even if the machine is relatively compact. In compact machines it is difficult to provide a belt such as 40 that is wide enough to accommodate legal or A3 stock for long-edge feed, i.e., the belt 40 would have to be over 14 inches wide, forcing the whole machine to have a certain depth. With the disclosed method, legal/A3 and letter/A4 sheets can be output at similar rates from, for instance, a "hallway" machine.

In operation, a casual human user of a printer simply indicates printing or copying of a document having a desired size of the output print sheets. The indicating can occur through local user interface 20 or a user interface such as a window on a remote computer (not shown). In response to receiving instructions for the particular desired output sheet size, the control system of the printer 10 selects the necessary velocity of belt 40, and further mandates control of pitch spacing on belt 40, to achieve the desired output rate. Once again, the output rate (pages output per minute) for one mode, such as for A4/letter, should not differ from the other mode, such as for A3/legal, by more than 25%. In terms of a user experience, the user should observe that a single printer 10 exhibits roughly the same output rate regardless of the desired output sheet size.

In setting up a pitch configuration for a desired output rate given a sheet size, the pitches could be spread evenly around the circumference of the belt 40, or there could be provided "skipped pitches", meaning portions of the belt where a page image could be placed but is not. Use of skipped pitches to obtain a desired output rate may be easier to enable than even distribution of pitches along the belt in some architectures.

Although a monochrome xerographic printing apparatus is shown in FIG. 1, the disclosure can readily be applied to a color printing apparatus, such as a color printer having multiple development units arranged around a single photoreceptor belt, or an ink-jet or xerographic printer using an intermediate transfer member.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A method of operating a printing apparatus, the apparatus having a control system and an imaging member movable in a process direction, comprising:

indicating a print sheet output size; and in response to the indicating, the control system operating the printing apparatus in one of a first output rate and a second output rate, the first output rate resulting from a first pitch spacing and a first velocity of the imaging member, and the second output rate resulting from a second pitch spacing and a second velocity of the imaging member;

retaining setpoint data that is used by the control system to instruct the printing apparatus to operate at the first output rate and the second output rate, the setpoint data being bias voltage of a charging device that results in a particular number of output pages per minute, wherein the second output rate is within 25% of the first output rate, and the second pitch spacing is consistent with a print sheet having a length along the process direction greater than 20% of a length of a print sheet output at the first sheet output rate.

2. The method of claim 1, wherein the second pitch spacing is consistent with a print sheet having a length along the process direction greater than 50% of a length of a print sheet output at the first sheet output rate.

3. The method of claim 1, wherein letter sheets are output at the first output rate and legal sheets are output at the second output rate.

4. The method of claim 3, wherein the letter sheets are output long-edge feed and the legal sheets are output short-edge feed.

5. The method of claim 4, wherein the imaging member is of a width to accommodate letter sheets at long-edge feed but not accommodate legal sheets at long-edge feed.

6. The method of claim 1, wherein A4 sheets are output at the first output rate and A3 sheets are output at the second output rate.

7. The method of claim 6, wherein the A4 sheets are output long-edge feed and the A3 sheets are output short-edge feed.

8. The method of claim 7, wherein the imaging member is of a width to accommodate A4 sheets at long-edge feed but not accommodate A3 sheets at long-edge feed.

9. The method of claim 1, further comprising indicating the print sheet output size through a user interface.

10. The method of claim 9, the user interface being substantially local to the printing apparatus.

11. The method of claim 1, wherein the imaging member is a photoreceptor.

12. The method of claim 1, wherein in at least one of the first output rate and second output rate, the pitch spacing is substantially even along the imaging member.

* * * * *